US007107762B2

(12) United States Patent
Hirooka

(10) Patent No.: US 7,107,762 B2
(45) Date of Patent: Sep. 19, 2006

(54) SECONDARY AIR SUPPLYING APPARATUS

(75) Inventor: Shigemasa Hirooka, Susosno (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 344 days.

(21) Appl. No.: 10/848,139

(22) Filed: May 19, 2004

(65) Prior Publication Data

US 2004/0255876 A1 Dec. 23, 2004

(30) Foreign Application Priority Data

Jun. 19, 2003 (JP) ..... 2003-174815

(51) Int. Cl.
*F01N 3/00* (2006.01)
*F01P 7/02* (2006.01)
*F02D 41/00* (2006.01)
*F25D 17/00* (2006.01)

(52) U.S. Cl. ..... 60/289; 60/293; 62/178; 123/41.05; 123/674

(58) Field of Classification Search ..... 62/178, 62/183; 60/277, 276, 288, 289, 290, 293; 123/41.05, 41, 41.04, 542, 672, 673, 674
See application file for complete search history.

(56) References Cited

U.S. PATENT DOCUMENTS 5,706,653 A 1/1998 Shoji et al.
5,881,552 A * 3/1999 Iwata et al. ..... 60/284
6,192,678 B1 * 2/2001 Tachibana ..... 60/289

FOREIGN PATENT DOCUMENTS

JP 6-248937 9/1994
JP 2000-240434 9/2000
JP 2004108265 A * 4/2004

* cited by examiner

*Primary Examiner*—Chen Wen Jiang
(74) *Attorney, Agent, or Firm*—Oliff & Berridge, PLC

(57) ABSTRACT

A secondary air supplying apparatus of the present invention comprises a secondary air supplying device for supplying secondary air to upstream of an emission purifying device in an exhaust system of an internal combustion engine, a coolant temperature sensor for detecting a temperature of a coolant for the engine, an intake air temperature sensor for detecting a temperature of intake air, a supply controller for actuating the secondary air supplying device in accordance with a predetermined secondary air supply condition, and a summing unit for summing an actuation period of the secondary air supplying device and storing a sum. The supply controller stops the secondary air supply by the secondary air supplying device when the sum stored by the summing unit reaches a predetermined upper limit. The summing unit resets the stored sum, if a difference between the coolant temperature and the intake air temperature at a point before the actuation of the secondary air supplying device is not more than a predetermined value. This configuration enables the apparatus to suppress oversupply of secondary air and overheating of a catalyst so as to implement appropriate activation of the catalyst.

9 Claims, 5 Drawing Sheets

ENGINE START STATE
XAI
XAIHIS
CAIONSUM
caion
COOLANT TEMPERATURE
INTAKE AIR TEMPERATURE
ON
OFF
ON
OFF
TSUM
ENGINE STOP DURING AI OPERATION
NO CLEAR EVEN WITH SMALL TEMPERATURE DIFFERENCE
COOLANT TEMPERATURE
INTAKE AIR TEMPERATURE
t0
t1
t2
t3
t4
t5

SECONDARY AIR SUPPLYING APPARATUS

BACKGROUND OF THE INVENTION

1. Field of the Invention

The present invention relates to secondary air supplying apparatuses for supplying secondary air to upstream of an emission purifying device of an internal combustion engine.

2. Related Background Art

An example of the known emission control systems of internal combustion engine is an apparatus with a three way catalyst in the exhaust system to reduce CO, HC, and NOx components in exhaust gas and thereby clean up exhaust emissions. Furthermore, there is a known technique of connecting a secondary air supply path equipped with a switching valve, to an exhaust manifold, and pressure-feeding air (secondary air) into the exhaust manifold by means of an air pump to increase the oxygen content in exhaust, thereby effecting the cleanup based on promotion of oxidation of HC and CO in exhaust (Japanese Patent Application Laid-Open No. 2000-240434: [0018]–[0030], FIGS. 3, 7–9).

The technology described in the above application is one for supplying the secondary air neither too much nor too little. The length of a duration during which the engine is kept at a stop is determined based on a difference between a coolant temperature at a stop of the engine and a coolant temperature at a start with the technology. When the duration of the engine stop is determined to be short, an actuation period of a secondary air supply system is adjusted according to a temperature difference between the coolant temperature at the start and an intake air temperature. Then the foregoing operation can suppress overheating of the catalyst and implement appropriate activation by shortening the actuation period of the secondary air supply system, when the duration of the engine stop is short and the temperature of the catalyst is high.

However, there are cases where an increase speed of the catalyst temperature is faster than an increase speed of the coolant temperature and where the catalyst has been already activated even at relatively low coolant temperatures. In such cases, where the actuation period of the secondary air supply system is too long, there are possibilities of causing overheating of the catalyst and damage due to continuous operation of the air pump.

SUMMARY OF THE INVENTION

An object of the present invention is to provide a secondary air supplying apparatus capable of implementing appropriate activation of the catalyst while suppressing the overheating of the catalyst even when the coolant temperature is relatively low.

A secondary air supplying apparatus according to the present invention comprises secondary air supplying means for supplying secondary air to upstream of an emission purifying device in an exhaust system of an internal combustion engine; coolant temperature detecting means for detecting a temperature of a coolant for the engine; intake air temperature detecting means for detecting a temperature of intake air; and supply controlling means for actuating the secondary air supplying means in accordance with a predetermined secondary air supply condition. The secondary air supplying apparatus of the present invention further comprises summing means for summing an actuation period of the secondary air supplying means and storing a sum, and, if the sum by the summing means reaches a predetermined upper limit, the supply controlling means stops the supply of secondary air by the secondary air supplying means. The summing means resets the sum if at a predetermined point before the actuation of the secondary air supplying means a difference between the coolant temperature detected by the coolant temperature detecting means and the intake air temperature detected by the intake air temperature detecting means is not more than a first predetermined value.

The intake air temperature is an environmental condition and is by no means affected by operating states of the engine. In contrast to it, the coolant temperature comes to agree approximately with the intake air temperature after a sufficient time has elapsed since a previous stop of the engine; however, before a sufficient time has elapsed since a stop of the engine, a decrease of the coolant temperature is small and a difference thereof from the intake air temperature becomes large. Namely, whether the time has elapsed since a stop of the engine can be determined from the difference between the coolant temperature and the intake air temperature. When it is not determined that the time has elapsed since a stop of the engine, the summing operation is started from the result of summing of the actuation period stored, so as to limit the actuation period of the secondary air supplying apparatus, whereby it is feasible to suppress excessive supply of secondary air and to appropriately activate the emission purifying catalyst.

The summing means does not reset the sum but continues summing, if at the predetermined point before the actuation of the secondary air supplying means the difference between the coolant temperature and the intake air temperature exceeds the first predetermined value.

In a preferred configuration, after the stop of the secondary air supply by the secondary air supplying means, if the coolant temperature is not less than a predetermined temperature or if the difference between the coolant temperature and the intake air temperature exceeds a second predetermined value larger than the first predetermined value, the summing means resets the sum stored at that point. In such case it is estimated that a warm-up is complete, and the resetting of the sum enables the apparatus to distinguish a warmed-up state.

In a preferred configuration, if a time not less than a predetermined time has elapsed since the stop of the secondary air supply by the secondary air supplying means, the summing means resets the sum stored at that point. This permits the apparatus to distinguish whether or not the internal combustion engine is repeatedly started.

Preferably, the summing means stores the sum if the engine is stopped during the actuation of the secondary air supplying means. Where the engine is stopped during the supply operation, storing the sum shortens the actuation period of the secondary air supplying apparatus at a next start, which can avoid oversupply of secondary air and shorten the actuation period of the air pump. In this case, preferably, the summing means does not reset the stored sum but continues summing, even if the difference between the coolant temperature and the intake air temperature is not more than the first predetermined value, after a restart of the internal combustion engine.

Preferably, the supply controlling means measures an on-duration of the secondary air supply by the secondary air supplying means and, if the duration reaches a predetermined upper limit, the supply controlling means stops the secondary air supply by the secondary air supplying means. This enables the apparatus to achieve optimal activation through the use of the sum based on the coolant temperature and the intake air temperature and to suppress the oversupply of secondary supply air more effectively.

Preferably, the supply controlling means measures an amount of the secondary air supply by the secondary air supplying means and, when the amount of the secondary air supply reaches a predetermined upper limit, the supply controlling means stops the secondary air supply by the secondary air supplying means. This enables the apparatus to achieve optimal activation through the use of the sum based on the coolant temperature and the intake air temperature and to suppress the oversupply of secondary supply air more effectively.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

The preferred embodiments of the present invention will be described below in detail with reference to the accompanying drawings. For easier understanding of description, the same components will be denoted by the same reference symbols throughout the drawings as much as possible, without redundant description.

Figure 1:
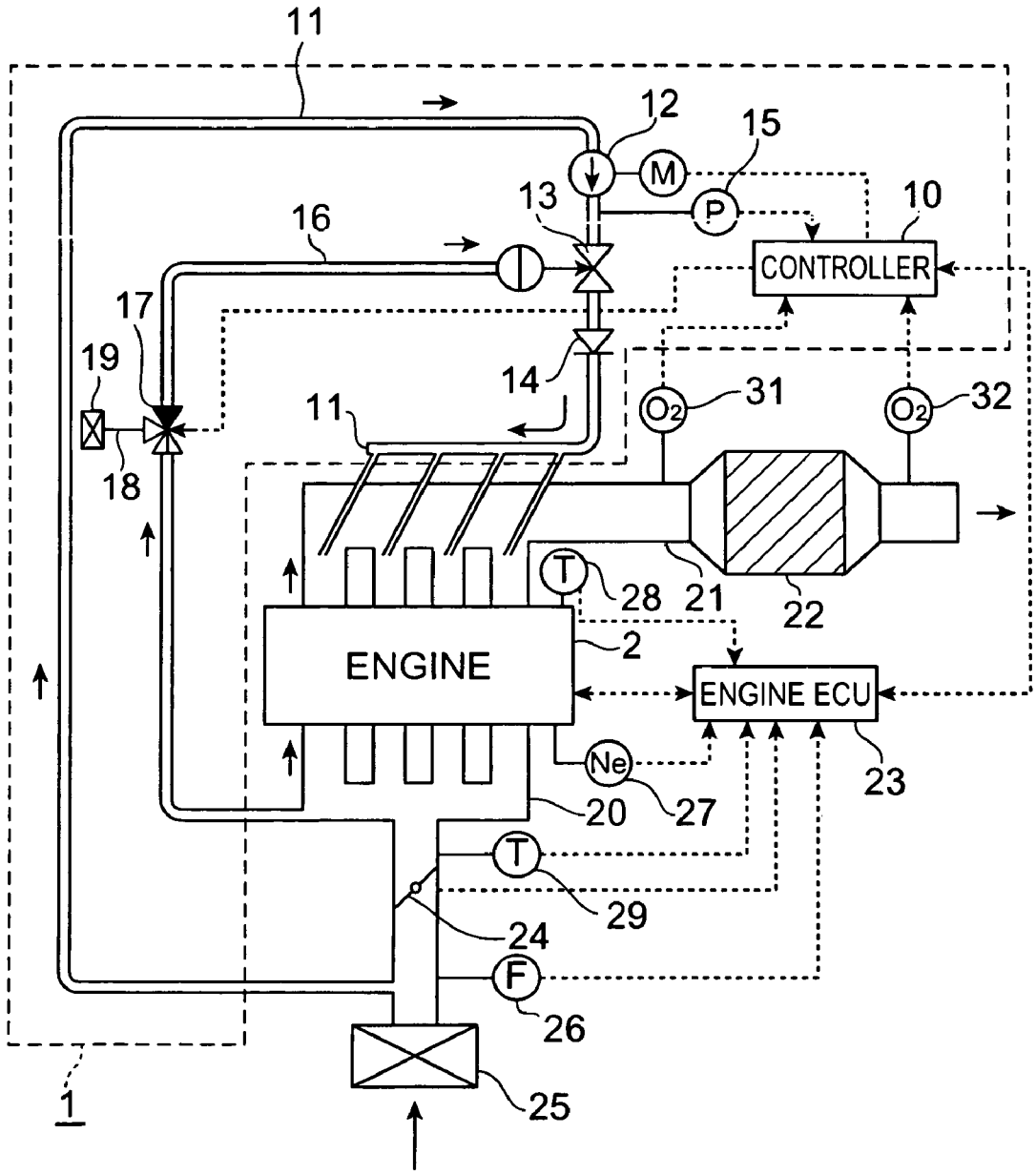
FIG. 1 is a schematic diagram showing a configuration of an internal combustion engine equipped with the secondary air supplying apparatus according to the present invention.

FIG. 1 is a schematic view showing the configuration of the internal combustion engine equipped with the secondary air supplying apparatus of the present invention. This secondary air supplier (secondary air supplying apparatus) 1 is attached to a multi-cylinder gasoline engine (hereinafter referred to simply as an engine) 2 being an internal combustion engine. This engine 2 is a 4-cycle engine. An intake pipe (manifold) 20 and an exhaust pipe (manifold) 21 are attached to the engine 2, and a throttle 24 is placed on the intake pipe 20. An intake air filter 25 is attached to an end of the intake pipe 20. An air flow meter 26 for measuring a quantity of air (quantity of primary air) is placed between the intake air filter 25 and the throttle 24. And a coolant temperature sensor 28 for detecting the temperature of the engine coolant and an intake air temperature sensor 29 for detecting the temperature of the intake air 29 are also installed. On the other hand, an emission purifying catalyst (device) 22 comprised of a three way catalyst is located on the exhaust pipe 21. $O_2$ sensors 31, 32 for detecting the oxygen content in exhaust are placed both upstream and downstream of the emission purifying catalyst 22. A/F sensors or linear O2 sensors may replace the $0_2$ sensors. A revolutions sensor 27 for detecting engine revolutions Ne is installed to the engine 2 and its outputs are input to the engine ECU 23 with the outputs of the air flow meter 26, the coolant temperature sensor 28 and the air temperature sensor 29.

The secondary air supplier 1 is provided with a secondary air supply path 11 connecting a position of the intake pipe 20 between the intake air filter 25 and the throttle 24 and a position of the exhaust pipe (manifold) 21 between the engine 2 and the upstream $O_2$ sensor 31. On this secondary air supply path 11 there are provided an air pump (AP) 12 of an electric motor driven type, an air-switching valve tASV) 13, and a reed valve (RV) 14 being a check valve, from the side of intake pipe 20. A pressure sensor 15 is located between AP 12 and ASV 13. Connected to this ASV 13 is a pipe 16 extending from downstream of the throttle 24 in the intake pipe 20, and a three-way valve 17 is provided on this pipe 16. The other port of the three-way valve 17 is connected through a pipe 18 and a filter 19 to the ambient air. The combination of ASV 13 and the three-way valve 17 may be replaced by one solenoid valve installed at the position of the ASV 13.

A controller 10 for controlling the operation of the secondary air supplier 1 is composed of a CPU, a RAM, etc. and is connected to an engine ECU 23 for controlling the engine, so as to be able to exchange information. The controller 10 receives output signals from the pressure sensor 15 and from the $O_2$ sensors 31, 32 and controls driving of the motor for AP 12 and opening/closing of the three-way valve 17. The controller 10 may be configured as part of the engine ECU 23.

This secondary air supplier 1 executes a secondary air supply control (hereinafter referred to as an AI [Air Injection] control) under predetermined conditions, e.g., in a state wherein a fuel concentration at a cold start or the like is high, an air-fuel ratio (A/F) is small, and the emission purifying catalyst 22 is not warmed up yet enough to fully demonstrate its performance. Embodiments of the AI control thereof will be described below.

Figure 2:
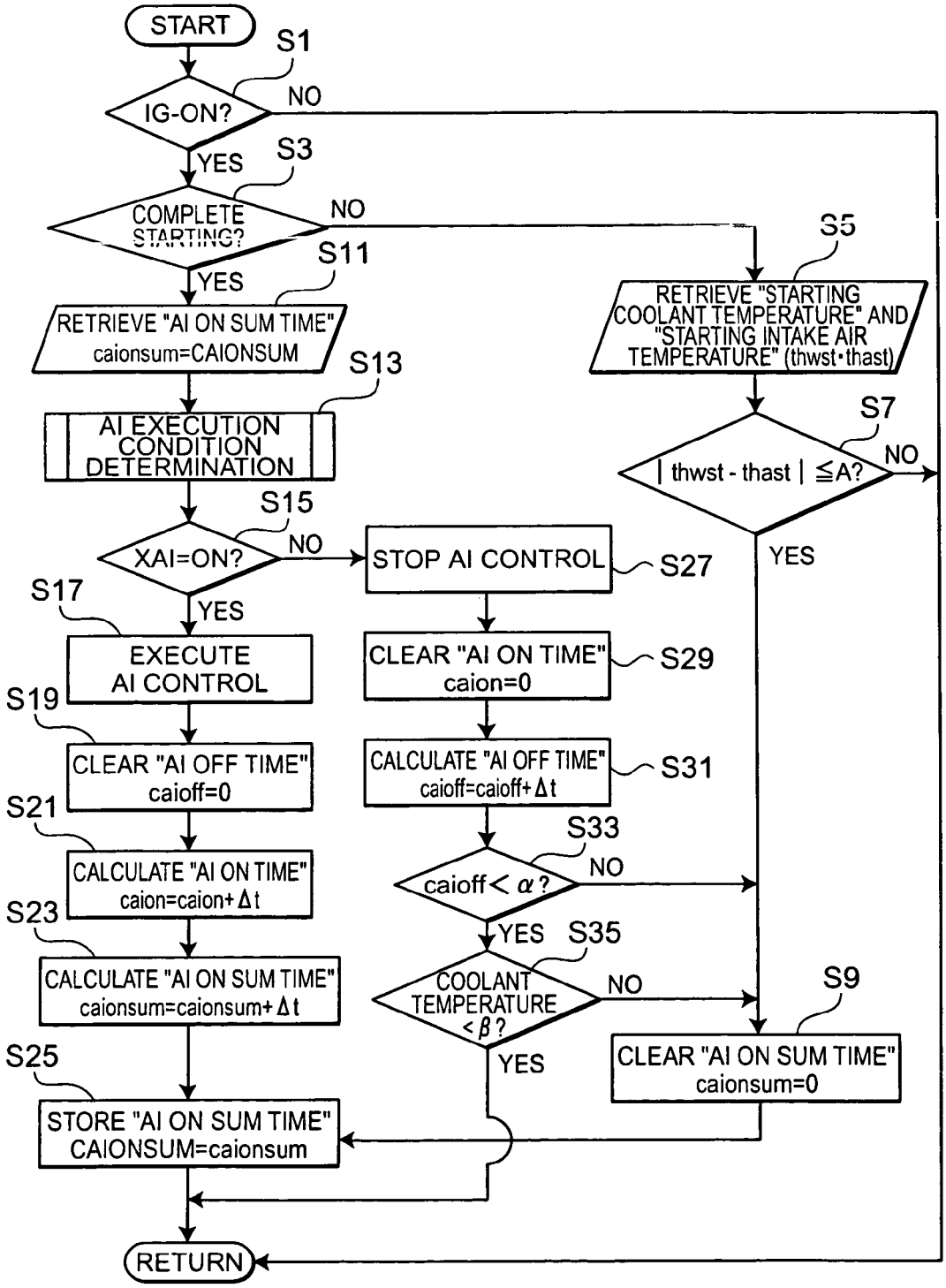
FIG. 2 is a flowchart showing processing in a first embodiment of the apparatus of FIG. 1.
Figure 3:
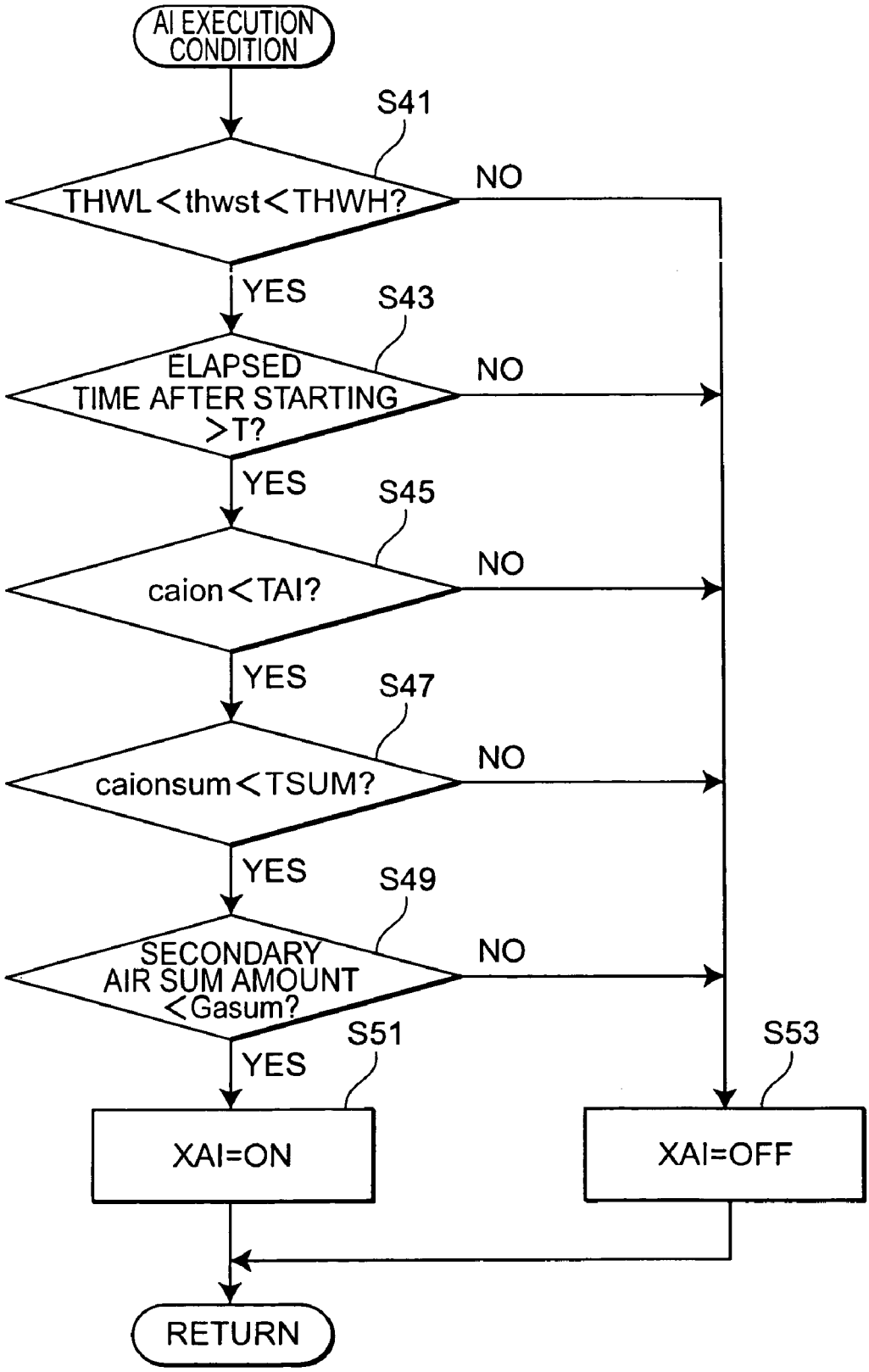
FIG. 3 is a flowchart showing an AI execution determining process in the processing of FIG. 2.

FIGS. 2 and 3 are flowcharts showing a first embodiment of the control. FIG. 2 is a flowchart of the main processing thereof. FIG. 3 is a flowchart showing an AI execution condition determining process in the main processing. The main processing of FIG. 2 is repeatedly executed at predetermined timings between an on time and an off time of power of a vehicle by the controller 1 in collaboration with the engine ECU 23. The process of FIG. 3 is called from the processing of FIG. 2 and then executed.

At the first step, it is determined whether the ignition (IG) switch of the vehicle is ON (step S1). When the IG switch is OFF, the processes thereafter are skipped to terminate the processing. When the IG switch is ON, it is then determined whether or not a starting of the engine 2 is completed (step S3).

When the starting is not completed, the controller moves to step S5 to retrieve a starting coolant temperature thwst measured by coolant temperature sensor 28 and a starting air temperature thast measured by intake air temperature sensor 29. Then an absolute value of a difference between them is compared with a predetermined threshold A (step S7). When the absolute value of the difference between the starting coolant temperature thwst and the starting air temperature thast exceeds the threshold A, the processes thereafter are skipped to terminate the processing. When the absolute value of the difference between the starting coolant temperature thwst and the starting air temperature thast is not more than the threshold A, an AI on sum time caionsum is cleared to 0 (step S9).

Then this AI on sum time caionsum is recorded as a variable CAIONSUM inside the controller 10 or in a storage device such as an external nonvolatile memory or storage medium (step S25) and then the processing is terminated. This variable CAIONSUM is stored even in a state in which the power of the vehicle is off. This storage device and the controller 10 constitute the summing means of the present invention.

When the starting of the engine 2 is completed at step S3, the controller moves to step S11 to retrieve the AI on sum time stored as the variable CAIONSUM in the storage device, into the variable caionsum. Then an AI execution condition is determined (step S13).

This AI execution condition determining process is to make determinations on five conditions at steps S41–S49 as shown in FIG. 3 and, when all the conditions are satisfied, the AI execution condition is determined to be satisfied and at step S51 an AI execution flag XAI is set to on. On the other hand, when any one of the conditions is not satisfied, the AI execution flag XAI is set to off at step S53 and the processing is terminated. The order of the determinations on the conditions at steps S41–S49 does not necessarily have to be limited to the illustrated one, but the order may be changed or the determinations may be made all at once.

Specific conditions include (1) the starting coolant temperature thwst is in a predetermined range above a predetermined lower limit THWL and below a predetermined upper limit THWH (step S41), (2) an elapsed time after a starting of engine 2 exceeds a predetermined threshold T (step S43), (3) an AI on time caion being one continuous on-duration of the AI control is less than a predetermined threshold TAI (step S45), (4) the AI on sum time caionsum is less than a predetermined threshold TSUM (step S47), and (5) a sum of supplied secondary air amount is less than a predetermined threshold Gasum (step S49).

Among these, the conditions (1) and (2) are start determination conditions for the AI control, wherein (1) is a condition for determination on a cold start and (2) is a condition for carrying out the AI control after the engine 2 is surely started, and the conditions (3)–(5) are conditions for determinations on an end of the AI control and conditions for suppressing oversupply of secondary air. Here the thresholds TSUM and TAI are set to satisfy the condition of TSUM≧TAI.

After a determination result is set, the controller moves to step S15 shown in FIG. 2, to carry out a branch process based on the value of XAI. When XAI is on, that is, when it is determined that the AI execution condition is met, the controller goes to step S17 to carry out the secondary air supply (AI control). Specifically, the controller controls the three-way valve 17 to establish communication of the pipe 16 with the intake pipe 20 and to guide a negative pressure in the intake pipe 20 to ASV 13 so as to open ASV 13, and AP 12 is driven. This results in guiding some of air having passed the air filter 25, through the secondary air supply path 11 into the exhaust pipe 21. As a result, the oxygen concentration in exhaust gas increases, the A/F increases, and secondary combustion of HC and CO in exhaust gas is promoted in the exhaust pipe 21, so as to implement cleanup of emissions. The secondary combustion increases the exhaust temperature to promote a temperature rise of the three-way catalyst of the emission purifying catalyst 22, thereby suppressing degradation of emissions.

After execution (start and continuation) of the AI control, an AI off time caioff is cleared to 0 (step S19), and a time step Δt is added to the AI on time caion (step S21). A time step Δt is also added to the AI on sum time caionsum (step S23), and the AI on sum time caionsum after the addition of Δt is stored as the variable CAIONSUM in the storage device (step S25), followed by an end of the processing.

On the other hand, when it is determined atstep S15 that XAI is off, i.e., that the AI execution condition is not met (either in a case where either of the AI start conditions is not met or in a case where one of the AI end conditions is met), the controller moves to step S27 to stop the secondary air supply (AI control). Specifically, the controller controls the three-way valve 17 to establish communication of the pipe 16 with the pipe 18 and guide the ambient air having passed the filter 19, to ASV 13 so as to close ASV 13, and the driving of AP 12 is terminated. This results in shutting off the supply of secondary air from the secondary air supply path 11 into the exhaust pipe 21.

After the stop of the AI control (including continuation of a stop state), the AI on time caion is cleared to 0 (step S29) and a time step Δt is added to the AI off time caioff (step S31). Then the resultant AI off time caioff is compared with a predetermined threshold α (step S33). When the AI off time caioff is less than the threshold α, i.e., when the stop-duration of the AI control is determined to be short, the controller goes to step S35 to compare the current engine coolant temperature with a predetermined threshold β. When the engine coolant temperature is less than the threshold β, it is determined that a warm-up is not adequately completed, and the processing is directly terminated. In this case, the value of the AI on sum time CAIONSUM stored in the storage device is stored.

On the other hand, when it is determined at step S33 that the AI off time caioff is not less than the threshold α and thus that the stop-duration is long, or when it is determined at step S35 that the engine coolant temperature is not less than the threshold β and thus that a warm-up is adequately completed, the controller goes to step S9 to reset the AI on sum time caionsum to 0. Then the AI on sum time caionsum after reset is stored as the variable CAIONSUM in the storage device (step S25) and the processing is terminated.

The secondary air supply control of the present embodiment involves the control using the off time (caioff) and the sum time (caionsum, CAIONSUM), in addition to the AI on time (caion). Namely, when the AI stop-duration is short or when the engine coolant temperature does not reach the predetermined temperature after a stop of AI, the AI on time as summed up is stored as the AI on sum time (steps S33, S35). When this AI on sum time is not less than the predetermined time, the AI control is completely terminated (to set the execution flag XAI to off: step S47→step S53). This operation can suppress the oversupply of secondary air; so as to curb the overheating of the catalyst and implement appropriate activation. Since intermittent, continuous operation of the air pump is restrained, damage thereof can be effectively prevented.

The above described the example in which the difference between coolant temperature and intake air temperature was calculated at a starting of the engine. It is, however, noted that the calculation of the difference does not necessarily have to be carried out at a starting of the engine. For example, whether a sufficient time has elapsed after a stop of AI can be determined from the difference between coolant temperature and intake air temperature, if the temperatures are detected at a time before and close to the time of a start of the secondary air supply. Accordingly, the measurement of the difference may be carried out at a time when the power of the vehicle is turned on, or immediately after a starting of the engine.

Figure 4:
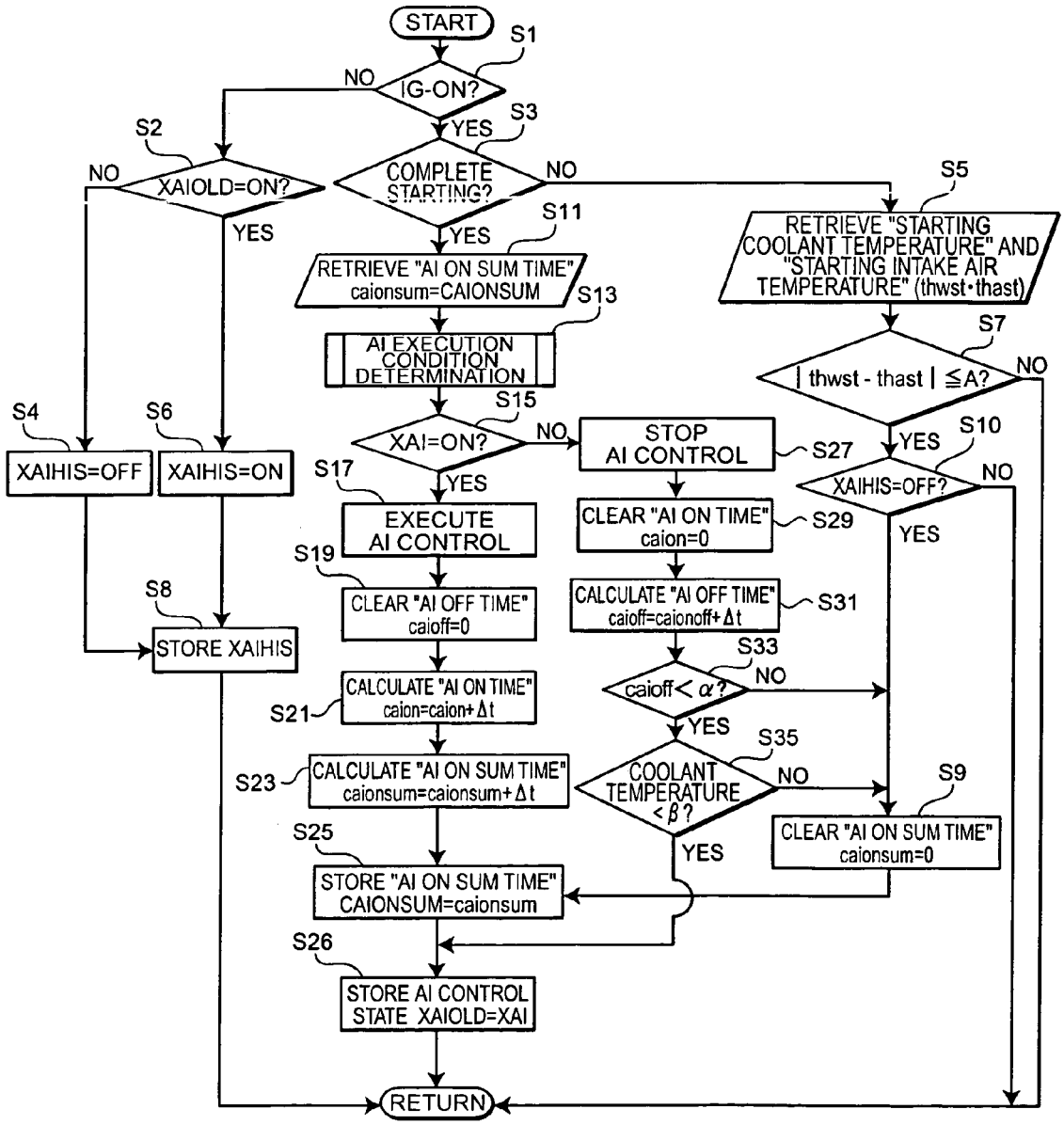
FIG. 4 is a flowchart showing processing in a second embodiment of the apparatus of FIG. 1.

A second embodiment of the AI control will be described below with reference to the flowchart shown in FIG. 4. This second embodiment includes some additional steps to the first embodiment to utilize a history of AI control states.

Specifically, after completion of step S25, or when it is determined at step S35 that the engine coolant temperature is less than the threshold β, the processing is not directly terminated, but the flag value XAI indicating a current AI control state is stored in XAIOLD as a previous value of AI state (step S26), and then the processing is terminated.

In the first embodiment, when it was determined at step S1 that the IG key was off, the processing was directly terminated; whereas in the present embodiment the controller moves to step S2 to check the previous value of XAIOLD of AI state. In accordance with the value of XAIOLD determined, the value of an AI state history XAIHIS is set to coincide therewith (step S4 or S6). Thereafter, the value of XAIHIS thus set is stored in the storage device, just as in the case of the variable CAIONSUM, (step S8) and then the processing is terminated. By this, an AI control state at a point of a stop of the engine is stored as the AI state history XAIHIS in the storage device and is stored even if the engine switch of the vehicle is turned off.

The processing with on of the IG switch is basically the same as in the first embodiment, but if at step S7 in a stop of the engine (before a start) the absolute value of the difference between the starting coolant temperature thwst and the starting air temperature thast is not more than the threshold A, the controller moves to step S10, instead of moving directly to step S9. The controller goes to step S9 only if at step S10 the AI state history XAIHIS is off. If at step S10 the AI state history XAIHIS is on, the processes of steps S9, S25, and S26 are skipped to end. When step S10 yields no, i.e., when the AI control was executed at a previous time, the value of the AI on sum time CAIONSUM is not cleared but is maintained in a state of a previous value.

In this manner, when the engine 2 is stopped during execution of AI, XAIOLD is stored as XAIHIS in the storage device at a point of the time of the engine stop, and the value of the AI on sum time is not cleared even if the difference between the engine coolant temperature and the intake air temperature is small at a next start time of the engine. Then the summing operation is further carried out from the previous sum value. This operation suppresses intermittent execution of the AI control, so as to prevent deterioration of the catalyst 22 due to oversupply, and damage of AP 12.

Figure 5:
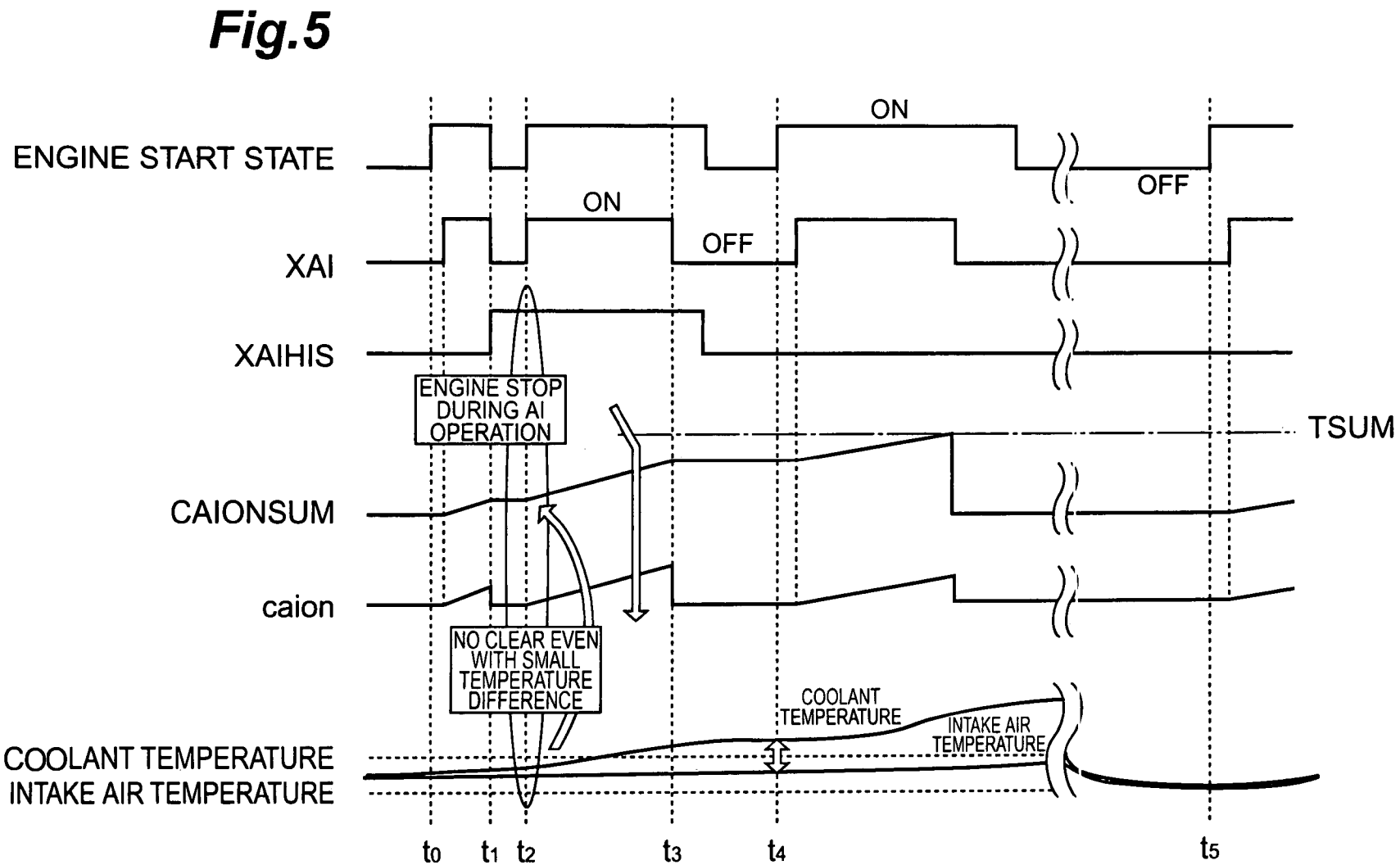
FIG. 5 is a timing chart showing changes of vehicle state quantities and control quantities during the control of FIG. 4.

FIG. 5 is a timing chart showing an example of time changes of engine start states, AI control flag XAI, AI state history XAIHIS, AI on time caion, AI on sum time CAIONSUM, coolant temperature, and intake air temperature in the case of the second embodiment being executed.

In the present embodiment, as shown in the figure, the value of the AI on sum time CAIONSUM is stored if the engine is stopped during the AI operation (times $t_1$–$t_2$) or if the difference between coolant temperature and intake air temperature is not less than the predetermined temperature (times $t_3$–$t_4$). In an AI operation thereafter, the summing operation is carried out from the stored value, so as to prevent the AI on-duration from becoming long during intermittent AI operation. This can prevent the damage of AP 12.

In the forms herein the coolant temperature was compared with the threshold β at step S35. However, another conceivable configuration is such that at step S35 the difference between coolant temperature and intake air temperature is compared with another threshold C [second threshold] (>the threshold A [first threshold]) and if the difference is larger than the threshold C it is assumed that a warm-up is thoroughly done, and the sum time is cleared (S35→S9).

As described above, the present invention involves counting the sum time of secondary air supply, storing and retaining the sum if the difference between coolant temperature and intake air temperature exceeds the first predetermined value, and stopping the operation of secondary air supply when the sum reaches the predetermined value, whereby the present invention suppresses the oversupply so as to prevent the overheating of the catalyst and occurrence of an overload on the air pump, and implements appropriate activation of the catalyst.

Furthermore, when the coolant temperature after a stop of the secondary air supply is not less than the predetermined value, when the difference between coolant temperature and intake air temperature is not less than the second predetermined value, or when a time not less than the predetermined time has elapsed since a stop of the secondary air supply, the sum is reset to enable more appropriate activation of the catalyst, suppression of overheating of the catalyst, and suppression of occurrence of an overload on the air pump.

Even if the difference between coolant temperature and intake air temperature is not more than the first predetermined value, the sum is not reset but is stored when the engine is stopped during the secondary air supply. This enhances the effect of suppressing intermittent, continuous operation of the air pump so as to prevent damage of the air pump.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A secondary air supplying apparatus comprising:

secondary air supplying means for supplying secondary air to upstream of an emission purifying device in an exhaust system of an internal combustion engine;

coolant temperature detecting means for detecting a temperature of a coolant for the engine;

intake air temperature detecting means for detecting a temperature of intake air;

supply controlling means for actuating the secondary air supplying means in accordance with a predetermined secondary air supply condition; and summing means for summing an actuation period of the secondary air supplying means and storing a sum, wherein the supply controlling means stops the supply of secondary air by the secondary air supplying means if the sum by the summing means reaches a predetermined upper limit, and wherein the summing means resets the sum if at a predetermined point before the actuation of the secondary air supplying means a difference between the coolant temperature detected by the coolant temperature detecting means and the intake air temperature detected by the intake air temperature detecting means is not more than a first predetermined value.

2. The secondary air supplying apparatus according to claim 1, wherein the summing means does not reset the sum but continues summing, if at the predetermined point before the actuation of the secondary air supplying means the difference between the coolant temperature and the intake air temperature exceeds the first predetermined value.

3. The secondary air supplying apparatus according to claim 1, wherein the summing means resets the sum, if the coolant temperature after the stop of the secondary air supply by the secondary air supplying means is not less than a predetermined temperature.

4. The secondary air supplying apparatus according to claim 1, wherein the summing means resets the sum, if the difference between the coolant temperature and the intake air temperature after the stop of the secondary air supply by the secondary air supplying means exceeds a second predetermined value larger than the first predetermined value.

5. The secondary air supplying apparatus according to claim 1, wherein the summing means resets the sum, if a time not less than a predetermined time has elapsed since the stop of the secondary air supply by the secondary air supplying means.

6. The secondary air supplying apparatus according to claim 1, wherein the summing means stores the sum even after a stop of the internal combustion engine, if the internal combustion engine is stopped during actuation of the secondary air supplying means.

7. The secondary air supplying apparatus according to claim 6, wherein the summing means does not reset the stored sum but continues summing, even if the difference between the coolant temperature and the intake air temperature detected is not more than the first predetermined value, after a restart of the internal combustion engine.

8. The secondary air supplying apparatus according to claim 1, wherein the supply controlling means measures a duration of the secondary air supply by the secondary air supplying means and, when the duration reaches a predetermined upper limit, the supply controlling means stops the secondary air supply by the secondary air supplying means.

9. The secondary air supplying apparatus according to claim 1, wherein the supply controlling means measures an amount of the secondary air supply by the secondary air supplying means and, when the amount of the secondary air supply reaches a predetermined upper limit, the supply controlling means stops the secondary air supply by the secondary air supplying means.

* * * * *